US005115893A

United States Patent [19]

Terkildsen

[11] Patent Number: 5,115,893

[45] Date of Patent: May 26, 1992

[54] TRAVEL DESK

[76] Inventor: Sydne N. Terkildsen, P.O. Box 1311, Williams, Calif. 95987

[21] Appl. No.: 804,690

[22] Filed: Dec. 11, 1991

[51] Int. Cl.[5] ..... A47B 3/10

[52] U.S. Cl. ..... 190/11; 190/102; 190/900

[58] Field of Search ..... 190/11, 102, 900; 108/43, 44, 50; 224/275, 277; 206/224, 232, 576

[56] References Cited

U.S. PATENT DOCUMENTS

| | | | |
|---|---|---|---|
| 3,541,976 | 11/1970 | Rozas | 108/43 |
| 3,701,576 | 10/1972 | Moen | 108/43 |
| 3,773,154 | 11/1973 | Mitchell . | |
| 4,034,518 | 7/1977 | Trecker | 190/11 |
| 4,132,295 | 1/1979 | Hochfelsen | 190/102 |
| 4,274,567 | 6/1981 | Sawyer | 224/277 |
| 4,420,270 | 12/1983 | Rossello | 190/900 |
| 4,483,427 | 11/1984 | Gerch . | |
| 4,515,493 | 5/1985 | Radovich . | |
| 4,700,634 | 10/1987 | Mills et al. . | |
| 4,747,490 | 5/1988 | Smith | 190/102 |
| 4,840,258 | 6/1989 | Tomikawa et al. | 190/102 |
| 4,901,901 | 2/1990 | Reitenour | 190/11 |

FOREIGN PATENT DOCUMENTS

| | | | |
|---|---|---|---|
| 1195440 | 11/1959 | France | 190/102 |

*Primary Examiner*—Gary E. Elkins

[57] ABSTRACT

An item carrying case and portable writing desk which includes an exposed exterior broard surface of the case structured as a working surface having various writing materials affixed thereon. The case includes a handle to allow carrying thereof with one hand. The writing materials includes a removable paper note pad, a plastic writing surface from which pencil lead and pen ink can be easily removed with a cloth or finger, and a re-attachable pen and pencil. Also affixed to the exposed exterior surface of the case adjacent the paper note pad is a detachable battery or solar powered electronic math calculator.

4 Claims, 5 Drawing Sheets

TRAVEL DESK

BACKGROUND OF THE INVENTION

1. Field of the Invention

The invention of this disclosure is a small, hand-carried item carrying case quite similar to a briefcase, which is additionally structured to also serve as a convenient portable writing desk.

2. Description of the Prior Art

With the advent of the cellular telephone and the overall competitiveness and quickened pace of business today, many businessmen have extended their offices to their cars. Invariably, these businessmen occasionally need to write down information while driving or stopped at a stop sign, which poses obvious difficulties. Although most businessmen carry attache or briefcases with them in order to carry important documents, forms, writing paper, pens and math calculators, it is quite inconvenient and distracting to open the case with one hand while driving and locate a piece of paper and a pen within the case. Then, the nearest available surface on which to write the message is the top surface of the attache case. Since the paper is not secured in position it will tend to slip about while trying to write on it, and the attache case itself may tend to slide on the surface of the car seat. Obviously, attempting to write down messages in this manner predisposes the driver to potential traffic hazards. Even as difficult as the procedure is, many businessmen will still invariably attempt to write down information while in a car, and this situation becomes even more frequent and difficult if he does business by a cellular car phone while driving.

Businessmen also occasionally need to write down information or calculate figures when they are not in a convenient place, such as walking through a warehouse, standing at a sales counter, or sitting in a chair without the benefit of a conventional writing desk. Even if he were walking and carrying a conventional attache case and it was light enough to easily hold in one arm to use as a writing surface, he would still have to hold the paper and calculator onto the surface, or hold the case horizontal so the writing materials would not fall off. Trying to hold an attache case horizontally and write on it at the same time is difficult whether standing or sitting.

Therefore, there is a need for a convenient easy to use device which allows the businessman or student or the like to quickly and conveniently jot down notes while driving, standing, or sitting in a chair without the benefit of a conventional writing desk. This device should also be light weight and easily carried. Since most businessmen and many students already carry attache cases out of necessity, it would be most convenient to provide a modified case which provided the necessary writing materials and still functioned as a conventional attache case.

The prior art, examined from a search conducted at the U.S. Patent and Trademark Office, does not provide a device which solves the problems previously mentioned in a manner providing the required convenience. Although some of the prior art devices provide item carrying cases adapted to serve primarily, or in part, as a travel desk, all appear to have major structural disadvantages which would render their use inconvenient in many situations. A relevant prior art device, which exhibits typical structural deficiencies common to many prior art devices in the field, is a combination attache case and travel desk described in U.S. Pat. No. 4,483,427, issued to E. L. Gerch on Nov. 20, 1984. Gerch's device includes an attach case with a working desk top compartment which is formed into the top surface of the lid of the case. The working desk compartment includes a hinged cover which encloses a narrow compartment housing a writing paper tablet and other miscellaneous writing paraphernalia of the user's choice. The first disadvantage of Gerch's device is that to gain access to the writing materials the cover to the compartment must first be opened. This would prove inconvenient, as previously described, if the person were driving a car especially if the latch to the cover were not positioned adjacent the driver. In such a situation the driver would have to reorient the case to open the latch and position the open cover so it was not hampering the driver's access to the writing materials within the case. Other obvious drawbacks to Gerch's device include the fact the case cannot be easily held by a person and used as a writing surface with the cover attached, and Gerch does not anticipate a removable cover. Should the person be right handed, he would naturally hold the case in his left arm and attempt to write with the right hand, in which case the user's right arm would be cramped by the cover. Since Gerch's cover is not removable, and hinges limit the openable range to ninety degrees, the cover would hinder the person's writing ability. If Gerch's case were held with the cover positioned adjacent the person he would still more than likely have difficulty seeing over the edge of the cover to the paper note pad. Similar problems would be encountered with a left handed person attempting to hold Gerch's case while writing. Gerch's paper note pad is also not securely fastened in position, having only the cardboard backing of the note pad slipped under an elongated cut-out, which could allow the note pad to slip sideways. Although Gerch's travel desk has a retaining lip surrounding the writing surface to retain writing materials and implements, those unaffixed writing implements such as pens or pencils would probably not be retained by the lip if the case were held by the user attempting to utilize the writing surface since the user would undoubtedly hold the case at an angle or slope to write a message. The user could also easily forget to include a pen or a calculator into the compartment and would not readily notice this fact since the cover would generally be in the closed position when being transported. Gerch has also not provided a method of preventing slippage of his case as on the car seat of a moving vehicle.

Gerch does not anticipate the use of his device in the same situations as I have previously described, such as jotting down notes while driving or walking and carrying the case, nor would his device function adequately under those conditions. The only writing materials Gerch's case is specifically designed to retain are a paper note pad and perhaps some loose papers. Gerch does not specifically include writing implements, but suggests their possible inclusion by the user, and he also does not mention the use or storage of a calculator within his device. Although these specific materials could be included by the user in the Gerch device, they are not specifically retained within the compartment and may eventually fall out and get lost. Therefore, Gerch does not provide a device structured in a manner to allow it to adequately function under the previously mentioned circumstances.

The other prior art devices examined had similar structural and therefore operational disadvantages as the Gerch device, for example lids or covers which must be opened or removed to access paper and writing implements, and or no facilities on the exposed exterior of the carrying case to secure writing paper stationary. These other relevant prior art devices were found in U.S. Pat. No. 4,700,634, U.S. Pat. No. 3,773,154, and U.S. Pat. No. 4,515,493.

SUMMARY OF THE INVENTION

The present invention provides an item carrying case substantially similar in many ways to a conventional attache or briefcase of the type characterized by rectangular flat top and bottom panels with an enclosable central storage area having substantially rigid split side and end walls. The split through the side and end walls form an openable seam for access into the interior of the case or the central storage area. One lengthwise side of the case, over the openable seam, is affixed with at least one hinge for hingidly affixing the top portion or lid to the bottom portion or base. There is also at least one lockable and releasible support hinge located on the interior of the case, which serves to limit the openable range of the lid and also support the lid in the open position. The side of the case opposite to the side containing the hinges forms the openable access. A carrying handle is also provided affixed to the exterior of the case. Latches are affixed to the exterior of the case on each side of the handle. The latches are arranged to lock the lid in a closed position, and to allow the user to open the case quickly with one hand, which would prove useful while driving.

The case is structured with accessory items to provide for quick and easy recording of written information especially while the person is driving, walking and carrying the case, or sitting in a chair with my invention in his lap. The broad exterior top surface of the case is affixed with a paper note pad, an electronic math calculator, two writing implements and a plastic writing surface for non-permanent written messages which are readily erasable. The paper note pad, being a thin rectangular pad is located towards the left hand side of the case lid. The note pad is releasibly retained stationary to the top surface of the case with the use of a flexible spring biased clamp on the top edge and an elastic band on the bottom edge of the note pad. The clamp holds the top edge of the note pad in a stable position for easy marking, and the elastic band on the lower end helps to keep the lower end of the pad from falling forward when the case is positioned vertically in the carrying position or in the wind such as in a car with the windows down.

Adjacent to the note pad on the right hand side of the case lid, is a removably affixed battery or solar powered electronic math calculator. The removable attachment of the calculator allows the calculator to be removed from the case as desired, for battery replacements for example. Next to the calculator on the far upper right hand corner the case surface, are two spring biased clips for releasably retaining a pen and pencil. Affixed below the calculator, towards the lower right edge of the case, is a thin sheet of plastic such as vinyl, preferably white in color, which can be written on with a pen or pencil, and then easily wiped off with a cloth, tissue or even the user's finger. This surface is for less permanent notes than those written on the paper note pad, and can also be used when the paper pad is full, or when two sets of notes are going at once for two different matters. The writing materials are specifically located on the exterior surface of the case generally in order of frequency of use. Since the note pad would generally be used more often, it is positioned closer to the openable edge of the case so it is easily reached by the driver, considering the fact that the majority of people are right handed. Also, when the person is holding the case and writing on the paper pad, which would be more frequently used, the right arm can rest on the portion of the case to the right of the paper note pad. Providing support for the writing arm, which for most people is the right arm, makes recording information much easier and also more legible.

The broad bottom surface of the case is affixed with rubbery skid-resistant pads which help prevent slipping of the case when on a slick surface and also help to prevent marring of the bottom surface. The pads are especially useful for stabilizing the case on the seat of a moving vehicle. The side panel of the case affixed with the hinges is affixed with four support feet which help protect the side surface from damage when the case is positioned vertically and resting on the ground. The user can use the case as a portable writing desk and jot down notes, addresses or phone numbers while driving without the case slipping on the surface of the car seat. Therefore, this invention is particularly well suited for the traveling business person where there is an occasional need for writing down information while driving. The portable writing desk provides stable writing surfaces of two kinds on which to quickly jot down short notes, which is much safer and convenient than trying to write on a loose sheet of paper while driving. The portable writing desk also comes in handy for occasions other than while traveling in a car, such as impromptu business meetings or sales calls were time is of the essence. On such occasions a calculator or writing implement may be required and the portable writing desk automatically provides these without the person having to spend time searching through the case for them. This invention also provides a portable case for storing papers and documents. The invention is also well suited for use by adult students and school age children.

Therefore, a primary object of the invention is to provide a combination item carrying case and portable writing desk having writing accessories conveniently placed for quick and easy note taking while driving, carrying the case, or sitting in a chair.

Another object of the invention is to provide the above in a combination case and portable writing desk with an easily accessible, removable electronic calculator.

A further object of the invention is to provide the above in a combination case and portable writing desk with a non-slip bottom surface for stabilizing the case such as during use in a moving automobile.

Other objects and advantages of the invention will become apparent by reading the following specification and examination of the accompanying drawings.

DESCRIPTION OF THE PREFERRED EMBODIMENT

Figure 1:
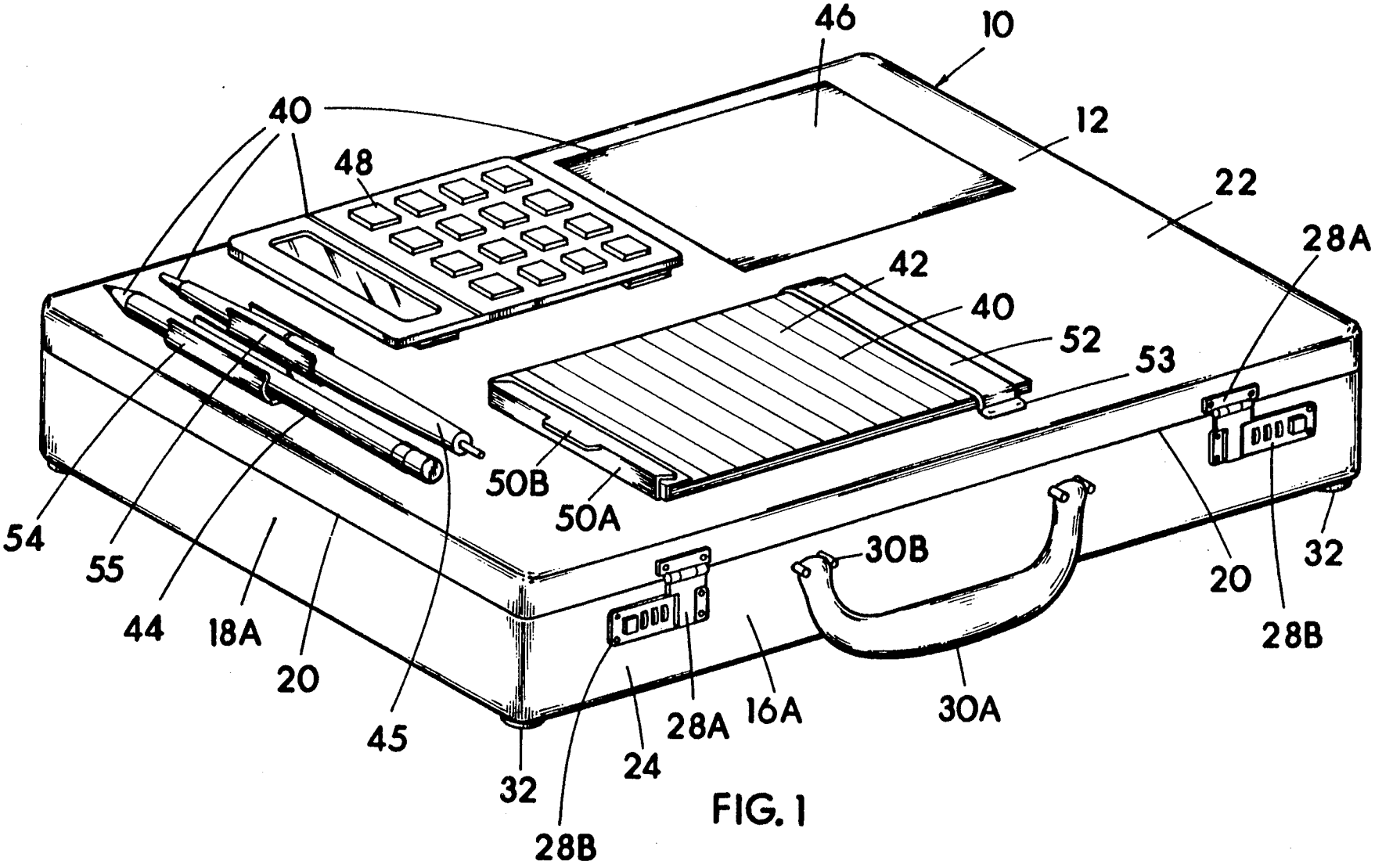
FIG. 1 is a top frontal perspective view of a preferred embodiment of my invention showing the writing materials and math calculator.
Figure 2:
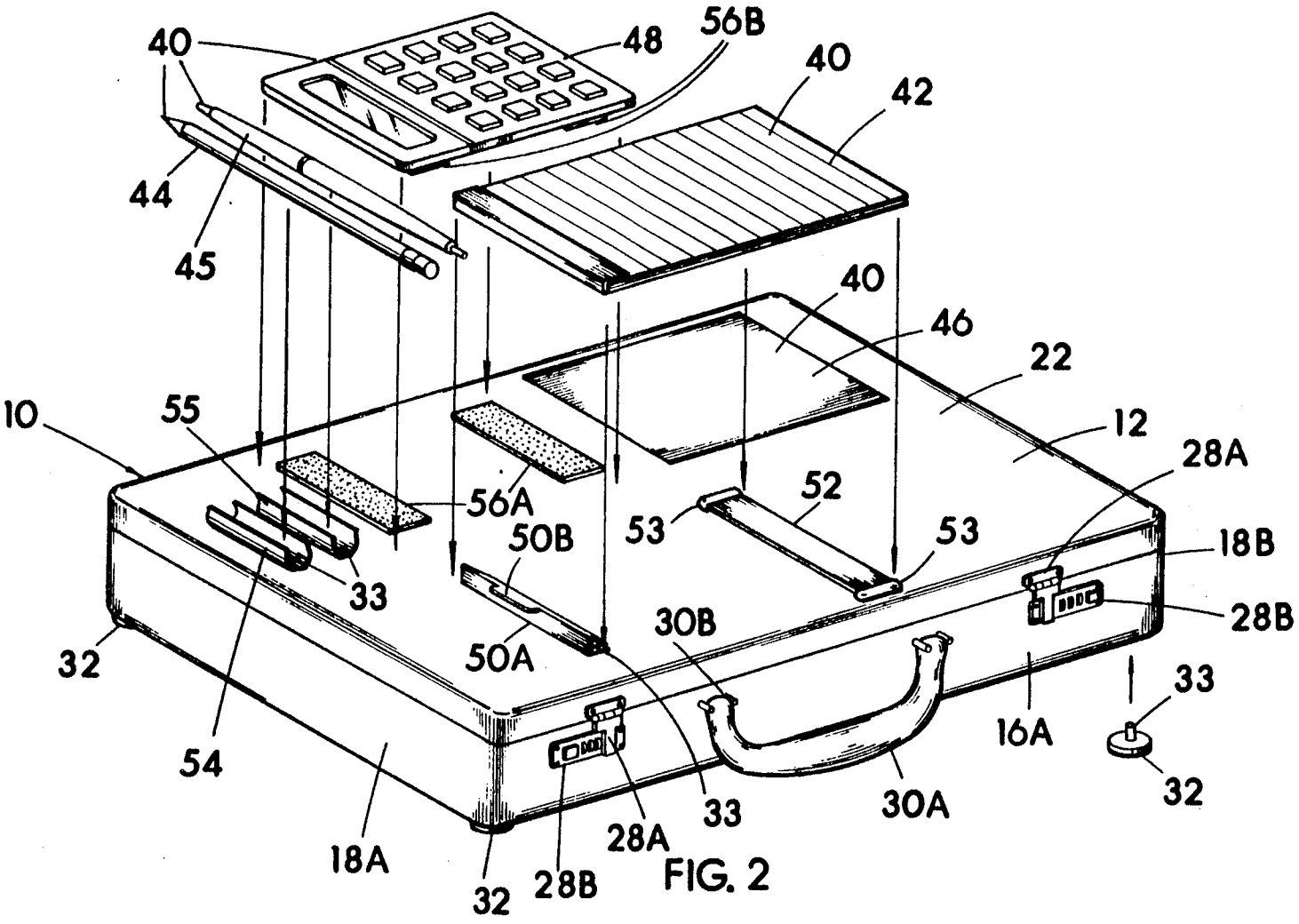
FIG. 2 is a top frontal perspective view of the FIG. 1 embodiment of my invention showing the removable writing accessories detached from the case.
Figure 3:
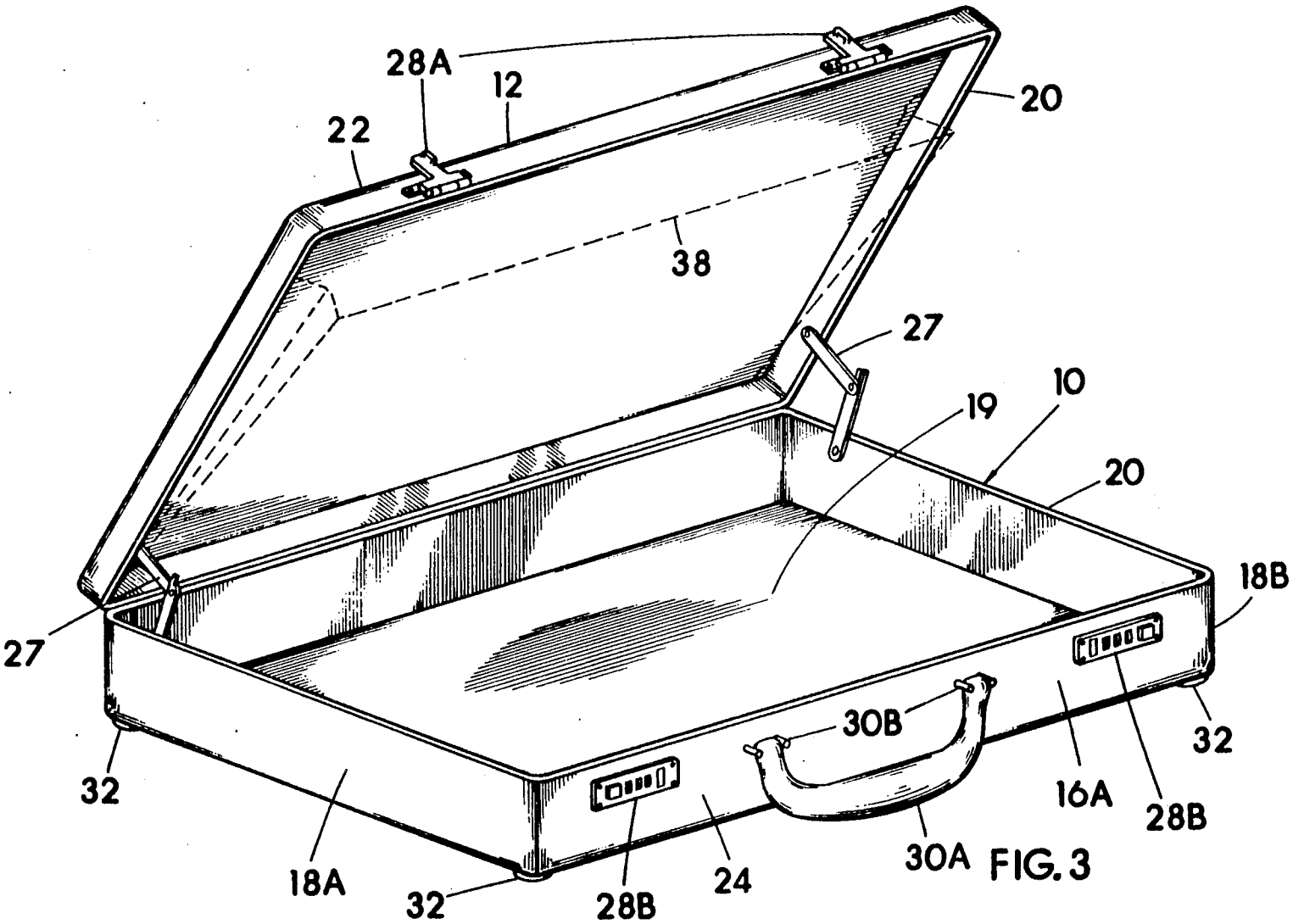
FIG. 3 is a top frontal perspective view of the FIG. 1 embodiment of my invention showing the case opened, illustrating the interior chamber and optional document divider.

Referring to FIGS. 1 through 5 wherein a structural embodiment of the present invention is shown for example. Case 10 includes a substantially flat rectangular top panel 12 and an oppositely disposed bottom panel 14, with two narrow side panels 16A and 16B oppositely disposed from one another and attached at the ends thereof to two narrow end panels 18A and 18B which are oppositely disposed from one another. Panels 16A, 16B, 18A and 18B connect to top and bottom panels 12 and 14 in substantially right angles so as to define a rectangular case 10. The side panels 16A and 16B and end panels 18A and 18B contain an openable seam 20 which separates case 10 into two sections, a relatively shallow box-shaped lid 22 and a slightly deeper box-shaped base 24. Panels 12, 14, 16A, 16B, 18A, and 18B in combination define a rectangular open interior chamber 19 of the case 10. The interior chamber 19 of case 10 is shown in FIG. 3 as having no compartments save an optional expandable pocket 38 affixed to the interior of lid 22 and shown in dotted lines, but could be compartmented in any manner seen fit. Expandable pocket 38 is best suited for retaining papers or documents. Case 10 is essentially structured very similar to many conventional attache cases and briefcases. The preferred outside dimension of case 10 is approximately 11 inches wide, 18 inches in length and about 3¼ inches in thickness, but of course this could be varied within the scope of the invention.

The material of manufacture of case 10 is to be light weight but also substantially rigid to provide sufficient support for writing on the surface thereof. Materials such as rigid plastics, metal, leather or plastic covered paper or wood might be suitable materials from which to manufacture case 10. A lightly padded exterior surface on case 10 as is somewhat common on briefcases will work as long as the case is generally rigid. The desired relative light weight, preferably under five pounds total, and small size of case 10 allows it to be easily portable by a person with one arm or hand.

Lid 22 is shown pivotally retained onto base 24 by two hinges 26, thereby providing an openable access into interior chamber 19. Hinges 26 are affixed over seam 20 on side panel 16B, with 16B being designated as the right side of case 10. Hinges 26 are swivel pin hinges affixed to case 10 with rivets 33 for example, but can also be any suitable hinging method such as a continuous piano-type hinge or a living hinge such as leather or plastic, depending upon the material of manufacture of case 10. To limit lid 22 to an opening range of approximately ninety degrees, two lockable and releasible support hinges 27 of a type commonly used on briefcases are affixed in the interior 19 to side panels 18A and 18B and to lid 22. Support hinges 27 are each comprised of two elongated metal plates pivotally affixed endwardly to one another with both terminal ends thereof affixed to case 10. Support hinges 27 also stabilize lid 22 in the open position, and prevent lid 22 from falling closed inadvertently.

A single pivotally affixed carrying handle 30A is affixed centrally to base 24 with a hinged handle attachment 30B, as shown in the drawings. Although not shown, carrying handle 30A can also be non-pivotally affixed to case 10, were case 10 manufactured of injected or blow molded rigid plastic.

Lid 22 can be connected and retained to base 24 in a closed position with the use of a latch 28A, and preferably two latches 28A. Latches 28A are affixed on side panel 16A of lid 22, just above seam 20, with one latch 28A on either side of handle 30A, and there is an interlocking cooperative latch section 28B located on base 24 on the upper edge of side panel 16A adjacent and aligned with each latch 28A. FIG. 1 shows latches 28A locked to latch members 28B to retain lid 22 in the closed position. Latches 28A with their cooperative members 28B are common type spring biased push button latch components which are operable with only the thumb of a single hand and may include combination or key lock components for security. The push button de-latching operation of latches 28A allows the user or businessman 29 to quickly open case 10 with only one hand while still keeping both eyes on the road while driving. The push button in this example is located one button on each latch member 28B, and when pushed releases the spring biased latch 28A which then spring to an unlock position as shown in FIG. 3 to allow the opening of case 10.

Figure 4:
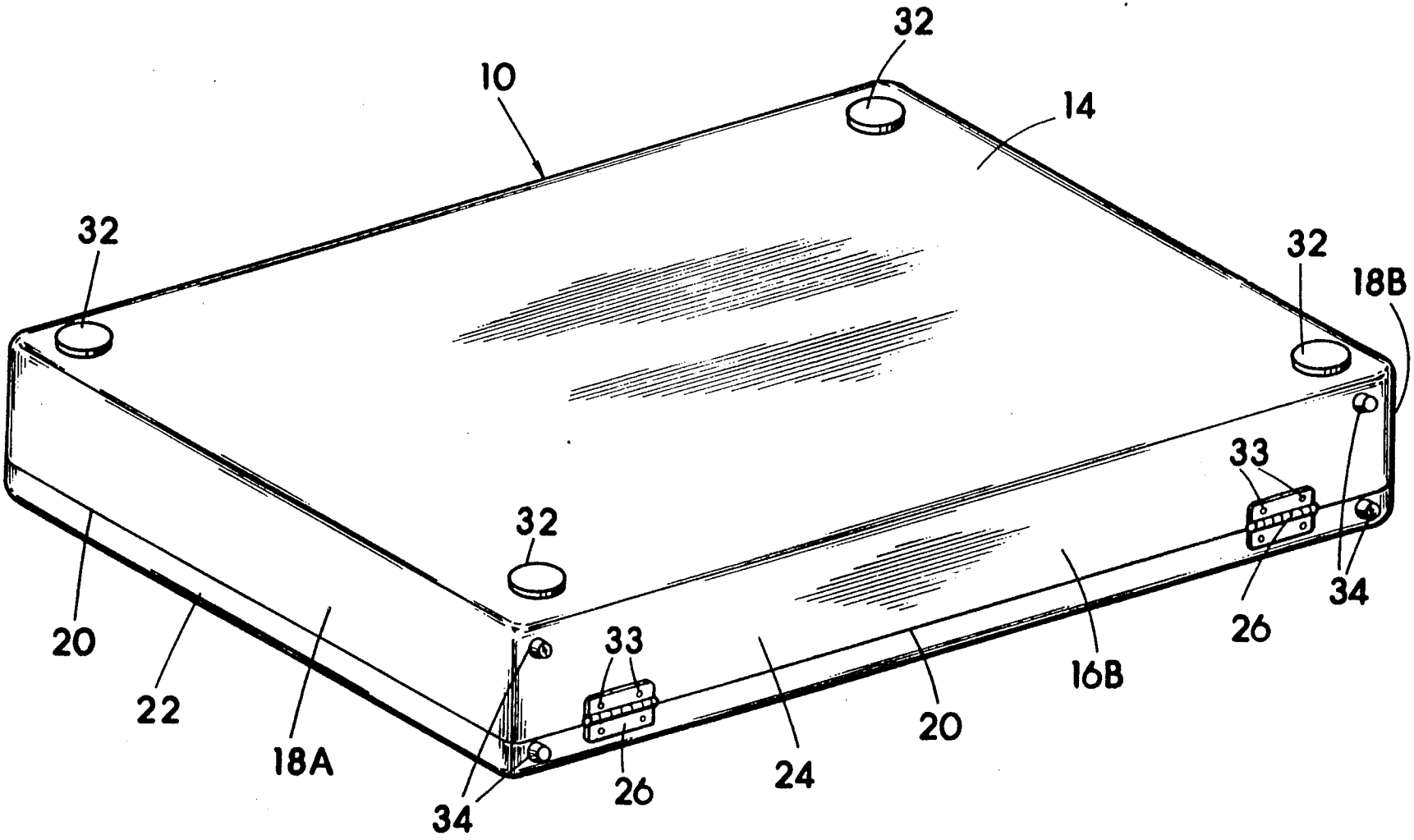
FIG. 4 is a bottom perspective view of the FIG. 1 embodiment of my invention showing the non-slip pads affixed to the bottom surface, and the support feet and hinges affixed to the side panel.

The outer corners of the exterior exposed surface of bottom panel 14 of case 10 are affixed with extending skid resistant pads 32, best shown in FIG. 2 and 4, which help prevent case 10 from sliding on slick surfaces, such as car seats. Pads 32 are preferably comprised of a mar resistant rubberized annular discs affixed to bottom panel 14 with the use of rivets or adhesives. Pads 32 can also be comprised of strips or a coating of non-slip material affixed to bottom surface of bottom panel 14. Pads 32 also raise bottom surface 14 slightly which helps to protect it from becoming marred.

Affixed by rivets or adhesives onto the outer corners of side panel 16B are four short knobs or support feet 34. Support feet 34 are preferably comprised of a mar resistant plastic or metal and serve to protect the outer surface of case 10 when positioned vertically and resting on the ground with side panel 16B repositioned as the bottom surface.

The exterior exposed surface of top panel 12 is affixed with writing materials generally designated by 40 which include a multi-sheet paper note pad 42, pencil 44, ink pen 45, plastic erasable writing surface 46 and also an electronic math calculator 48 since it does display written information. The outer surface of top panel 12 is oriented with the right edge of top panel 12 positioned adjacent side panel 16B, the left edge adjacent side panel 16A, the upper edge adjacent end panel 18A and the lower edge adjacent end panel 18B. This orientation provides for convenient use of the writing materials 40 both when driving and while carrying case 10. Writing materials 40 are conveniently positioned for use by businessman 29 while driving, while standing or walking and carrying case 10, or sitting in a chair with the case 10 in his lap.

Located in the far upper right hand corner of top panel 12 are the hand-holdable writing implements, pencil 44 and pen 45, retained releasibly in spring biased pencil clip 54 and pen clip 55 respectfully. Pencil clip 54 and pen clip 55 are elongated trough-like plastic or metal structures, open at the tops, and structured to securely grip pencil 44 and pen 45 when snapped into the rounded interior of clip 54 or 55. Although not shown, other methods of retaining pencil 44 and pen 45 could be used.

Paper note pad 42 is affixed on the left hand surface of top panel 12 and includes a conventional paper tablet preferably comprised of a plurality of removable or tear-off sheets of lined paper, sized approximately 5½ inches wide, by 8 inches long and about ¼ inch in thickness. The top edge of note pad 42 is releasably retained by a flexible spring biased clamp 50A, best shown in FIG. 2. Clamp 50A is basically an elongated U-shaped channel with an outward projecting flange 50B, preferably comprised of a semi-rigid resilient plastic or metal, affixed to top panel 12 with rivets 33 or other suitable attachment methods such as adhesives, and is similar to the clamps commonly used on clip boards. The upper edge of paper note pad 42 is inserted into the opening of clamp 50A while the user pushes down on flange 50B. The resilient nature of clamp 50A allows it to attempt to regain its former normally closed shape, whereby it clamps tightly against paper note pad 42 since paper note pad 42 is slightly larger than the opening of clamp 50A. Spring biasing could also be provided with a torsion spring for example, especially if clamp 50A were manufactured of metal. The lower edge of note pad 42 is retained in position with the use of a resilient elastic band 52, each terminal end of which is shown affixed to lid 22 with a metal crimp fastener 53 attached by rivets or other suitable fastening methods such as adhesives, with the central portion of band 52 left detached from case 10. Elastic band 52 stretches significantly and easily allows the lower edge of paper note pad 42 to be slid underneath. Clamp 50A holds paper note pad 42 firmly in place so it can be easily written on, and elastic band 52 helps prevent the bottom edge from falling freely when case 10 is in a vertical or carrying position.

Directly adjacent to paper note pad 42 is calculator 48, located along the right edge of top panel 12. Calculator 48 can be any make or model of a battery or solar powered unit, as long as the dimensions are appropriate for attachment to top panel 12. Preferably, calculator 48 is within approximately 2.5 inches in width and 4.25 inches in length, and about ¼ inch in thickness, but of course these dimensions could be varied. Calculator 48 is removably affixed to top panel 12 with the use of two mating strips of hook and loop fasteners 56A and 56B. One hook and loop fastener, 56A, is permanently affixed to the surface of top panel 12 with adhesives, and the opposite mating section, 56B, is releasably affixed to the back surface of calculator 48, avoiding the battery compartment. The releasable adhesive used on hook and loop fastener 56B allows removal from the back surface of calculator 48 in the event calculator 48 needs to be replaced. The releasable adhesive should be stronger than the attachment of the mating sections of hook and loop fasteners 56A to 56B, to avoid inadvertent removal of the mating section of hook and loop fastener 56B from the back of calculator 48 when removing calculator 48 from case 10. Once both mating sections of both strips of hook and loop fasteners 56A and 56B are affixed to their respective surfaces, calculator 48 can be attached to top panel 12. Should the batteries need replacing, calculator 48 can be easily removed and re-affixed. As an alternative method, case 10 can be provided with two un-affixed mating strips of hook and loop fasteners 56A and 56B, but not provided with calculator 48. This would enable businessman 29 to mount his own calculator onto lid 22 in any available space or position desired.

Affixed next to calculator 48 on the lower edge of top panel 12 is plastic erasable writing surface 46 which is a thin panel maybe about 4 inches by 6 inches in size. Plastic writing surface 46 is a flat, thin rectangular section of plastic such as vinyl, the surface of which can be marked with pencil 44 or pen 45, or other writing implements. Plastic writing surface 46 is preferably a light color to contrast with the dark graphite of the pencil 44 or ink of pen 45. The smooth refractive surface of plastic writing surface 46 does not absorb the graphite of pencil 44 or the ink of pen 45, and therefore allows all markings to be erased or wiped off with a tissue or even a person's finger. Plastic writing erasable surface 46 is an accessory writing surface in addition to paper note pad 42. It would primarily be used for quickly writing short temporary messages, perhaps when paper note pad 42 was full. Adhesives could be used to attach plastic erasable writing surface 46 to case 10.

Figure 5:
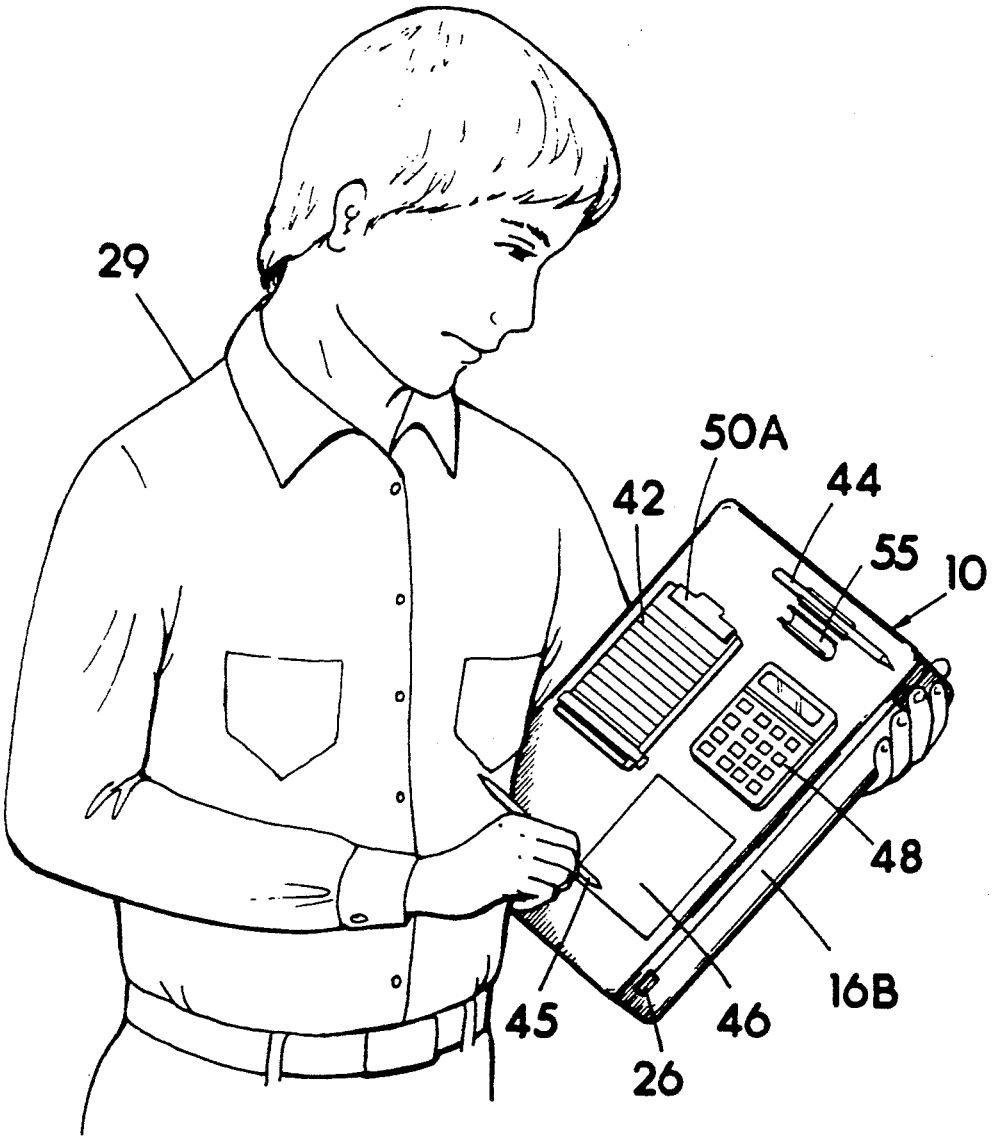
FIG. 5 is an in-use illustration of the FIG. 1 embodiment of my invention depicting a person using my invention while in a standing position.

One of the beneficial uses of this invention includes its use by the businessman 29 while driving his car. All writing materials 40 are specifically located in relation to their frequency of use. Since paper note pad 42 would be more frequently used than the other articles, it is positioned closest to the right side of case 10 or side panel 16A, which is to be positioned facing the driver when traveling in a car. Note pad 42 is then within easy reach of the driver, where only short quick glances are needed to find pencil 44 or pen 45 and jot down short messages on paper note pad 42. Case 10 is also useful to the businessman 29 who requires the simultaneous use of calculator 48, pencil 44 and note pad 42 while traveling on a train or bus, or walking about inspecting inventory. In such instances where the user is walking or in movement, it would be most difficult to maintain even some of the writing materials 40 on a slick surface, such as an attache case, without having them slide off. With case 10, all the writing materials 40 that the user would generally need are instantly available and affixed in a stable position. The size and weight of case 10 are significant in that it is specifically structured for being easily supported by one arm, as shown in FIG. 5. It has been found that the width of case 10, being approximately 11 inches, is easily held in one arm between the inside joint of the elbow and the wrist of the average businessman 29. Other dimensions of case 10 may of course be used, such as a smaller case 10 directed for use possibly by school children. Case 10 is therefore not too large to be cumbersome nor too heavy to be fatiguing for a person to carry for an extended length of time. The instant availability of the writing materials 40 is also important for sales calls where the businessman 29 needs to make quick and accurate quotes for a client. There is no need to fumble through case 10 looking for a calculator 48 with which to figure those quotes.

This invention therefore provides the most frequently used writing materials 40 that an average businessman 29 would commonly use, in combination with a device which the businessman 29 generally already has, namely an attache case. The combination of these elements not only increases the available storage space of the interior case 19 by placing some elements which are normally stored within the case on the exposed exterior of the case, but reduces the time element required to find the individual writing materials 40. Individual un-affixed writing materials 40 also have the potential of becoming lost or misplaced even when stored within an attache case. Since writing materials 40 are affixed to the exterior of case 10, the user always knows where to find them, and can generally tell at a glance if they need replenishing or replacing.

Although not shown in the drawings, one alternative embodiment of the invention is anticipated wherein the top surface of lid 22 can be modified with recessions sized to retain the various writing materials 40. The recessions would be of a depth generally equal to the thickness of each of the writing materials 40. This feature may further help to maintain all the writing materials 40 in position, especially when transporting case 10 in the vertical or carrying position. Although this feature may also help prevent the writing materials 40 from being dislodged when case 10 is being transported, it may also be harder to write on a recessed surface, more difficult to remove a recessed pencil 44 or pen 45, and it may also significantly increase the cost of manufacture of case 10.

Although I have very specifically described and shown a preferred structure of my invention, it should be understood that the specific details are given for example to those skilled in the art. Many minor changes in the specific structures described may be made without departing from the true scope of my invention, and therefore it should be understood that the scope of my invention is to be determined by the spirit and scope of the appended claims.

What I claim as my invention is:

1. A carrying case and portable writing desk combination structured for carrying items within the case and for providing an easily employed message recording surface, comprising, a generally flat top panel and an oppositely disposed generally flat bottom panel, two narrow side panels connected to said top panel and said bottom panel, and two narrow end panels connected to said top panel and said bottom panel and further connected to said side panels so as to define a generally rectangular case having a hollow interior for storing items therein;

said case having a separable seam extending through said case dividing said case into a base and a lid;

at least one hinge attached to said base and spanning across said seam and affixing to said lid to hingidly attach said lid to said base so as to allow raising said lid relative to said base to gain access to said interior of said case;

at least one handle attached to an exterior surface of said case so as to allow carrying of said case by said handle;

at least one latching means, a first portion of said latching means affixed to said lid, and a second portion of said latching means affixed to said base and aligned with said first portion of said latching means so as to allow releasible securement of said lid in a closed position to said base of said case;

a plurality of writing materials affixed on an exterior exposed surface of said top panel of said case so as to render said writing materials stationary relative to said case and readily accessible, said writing materials including at least one multi-sheet paper note pad, said paper note pad being releasibly secured to said top panel of said case by at least one first clamping means affixed to said top panel, said writing materials further including at least one hand-holdable writing implement, said writing implement being releasibly secured to said top panel of said case by at least one second clamping means affixed to said top panel.

2. A carry case and portable writing desk combination according to claim 1 wherein said writing materials further include at least one electronic calculator affixed to said top panel of said case, said calculator affixed to said top panel of said case by releasible attachments means so as to allow removal of said calculator from said case a desired.

3. A carrying case and portable writing desk combination structured for carrying items within the case and for providing an easily employed message recording surface, comprising, a generally flat top panel and an oppositely disposed generally flat bottom panel, two narrow side panels connected to said top panel and said bottom panel, and two narrow end panels connected to said top panel and said bottom panel and further connected to said side panels so as to define a generally rectangular case having a hollow interior for storing items therein;

said case having a separable seam extending through said side panels and said end panels dividing said case into a base and a lid;

at least one hinge attached to said base and spanning across said seam and affixing to said lid to hingidly attach said lid to said base so as to allow raising said lid relative to said base to gain access to said interior of said case;

releasibly lockable hinge support means connected to said base and to said lid, said hinge support means providing means for maintaining said lid in a raised position and for limiting the degree said lid may be raised;

at least one handle attached to an exterior surface of said case so as to allow carrying of said case by said handle;

at least one latching means, a first portion of said latching means affixed to said lid, and a second portion of said latching means affixed to said base and aligned with said first portion of said latching means so as to allow releasible securement of said lid in a closed position to said base of said case;

skid resistant means affixed to an exterior exposed surface of said bottom panel providing means for reducing sliding of said case when on a surface;

a plurality of writing materials affixed on an exterior exposed surface of said top panel of said case so as to render said writing materials stationary relative to said case and readily accessible, said writing materials including at least one multi-sheet paper note pad, said paper note pad being releasibly secured to said top panel of said case by at least one first clamping means affixed to said top panel, said writing materials further including at least one hand-holdable writing implement, said writing implement being releasibly secured to said top panel of said case by at least one second clamping means affixed to said top panel, said writing materials further including at least one electronic calculator affixed to said top panel of said case, said calculator affixed to said top panel of said case by releasible attachments means so as to allow removal of said calculator from said case as desired.

4. A carrying case and portable writing desk combination structured for carrying items within the case and for providing an easily employed message recording surface, comprising, a generally flat top panel and an oppositely disposed generally flat bottom panel, two narrow side panels connected to said top panel and said bottom panel, and two narrow end panels connected to said top panel and said bottom panel and further connected to said side panels so as to define a generally rectangular case having a hollow interior for storing items therein;

said case having a separable seam extending through said side panels and said end panels dividing said case into a base and a lid;

at least one hinge attached to said base and spanning across said seam and affixing to said lid to hingidly attach said lid to said base so as to allow raising said lid relative to said base to gain access to said interior of said case;

releasibly lockable hinge support means connected to said base and to said lid, said hinge support means providing means for maintaining said lid in a raised position and for limiting the degree said lid may be raised;

at least one handle attached to an exterior surface of said case so as to allow carrying of said case by said handle;

at least one latching means, a first portion of said latching means affixed to said lid, and a second portion of said latching means affixed to said base and aligned with said first portion of said latching means so as to allow releasible securement of said lid in a closed position to said base of said case;

skid resistant means affixed to an exterior exposed surface of said bottom panel providing means for reducing sliding of said case when on a surface;

a plurality of writing materials affixed on an exterior exposed surface of said top panel of said case so as to render said writing materials stationary relative to said case and readily accessible, said writing materials including at least one multi-sheet paper note pad, said paper note pad being releasibly secured to said top panel of said case by at least one first clamping means affixed to said top panel, said writing materials further including at least one writing surface affixed to said top panel of said case adjacent said paper note pad with said writing surface providing a surface for writing on which the writing is readily erasable, said writing materials further including at least one hand-holdable writing implement, said writing implement being releasibly secured to said top panel of said case by at least one second clamping means affixed to said top panel, said writing materials further including at least one electronic calculator affixed to said top panel of said case, said calculator affixed to said top panel of said case by releasible attachments means so as to allow removal of said calculator from said case as desired.

* * * * *